United States Patent [19]

Schiemann

[11] 4,347,954

[45] Sep. 7, 1982

[54] CLOSURE FOR A CANISTER

[76] Inventor: Wolfram Schiemann, Hohenzellern Platz 1, 7140 Ludwigsburg, Fed. Rep. of Germany

[21] Appl. No.: 196,194

[22] Filed: Oct. 10, 1980

[51] Int. Cl.[3] ..... B67D 3/00

[52] U.S. Cl. ..... 222/484; 222/542; 222/568; 222/479; 215/309

[58] Field of Search ..... 222/505, 517, 568, 542, 222/484, 479; 220/288; 215/309

[56] References Cited

U.S. PATENT DOCUMENTS

| | | | |
|---|---|---|---|
| 3,405,837 | 5/1967 | Carpenter, Jr. | 220/288 |
| 3,744,656 | 7/1973 | Schiemann | 215/31 |
| 3,844,456 | 10/1974 | Schiemann | 222/545 |
| 4,164,304 | 8/1979 | Roberson | 220/288 |

FOREIGN PATENT DOCUMENTS

| | | | |
|---|---|---|---|
| 1215942 | 12/1970 | United Kingdom | 215/309 |

*Primary Examiner*—Robert J. Spar
*Assistant Examiner*—Patricia Ray

[57] ABSTRACT

A claw closure for a plastic threaded nipple on an extruded plastic canister is tiltably carried by an external metallic collar on the nipple. The metallic collar carries a lid with a ring seal held between inner and outer flanges on the lid bottom. An internal ring in the nipple has a radial flange over the threaded nipple and is integral with the external collar. The internal ring has an axial internal thread for 20 liter canisters. The radial faces of the collar and the internal ring are aligned and set off from each other by an annular groove into which the inner flange of the lid bottom extends. An axial venting hole is provided in the wall region of the internal ring.

4 Claims, 4 Drawing Figures

CLOSURE FOR A CANISTER

This invention relates to a claw closure for a plastic threaded nipple in an extruded plastic canister which is tiltably carried by an external metallic collar on the nipple. The metallic collar carries a lid with a ring seal held between inner and outer flanges on the lid bottom. An internal stiffening ring in the nipple has a radial flange which extends over the nipple. Canisters made of plastic are lighter than those made of sheetmetal. This is particularly noticeable in the 20 to 30-liter ranges, where the percentage differences also entail considerable absolute differences in weight. In contrast to sheetmetal canisters, plastic canisters do not rust, nor do they rattle.

BACKGROUND OF THE INVENTION

For these plastic canisters, closures have been developed which are described, for example, in U.S. Pat. No. 3,844,456. Such closures can be opened and closed very rapidly with a single motion of the hand. This is very important in emergency situations. The lid of the closure does not interfere with the pouring and it does not get lost. Such closures withstand drops without losing their tightness. The construction of these closures also makes it possible to arrange the air tubes advantageously so that the liquids run out with a minimum of gurgling. Moreover, they also run out quickly with such an arrangement because no air has to be drawn in through the actual discharge opening.

Furthermore, sheetmetal canisters have become known in which from the upper portion of the canister an annular hole is cut out near the handles. Sheetmetal canisters must always be welded together from at least two parts in order to form a hollow body. Since the circular cutout is located symmetrically in the center and is, moreover, relatively large, it is in no case possible at that point to tolerate a sheetmetal fold which after all would have to be welded. Into the circular cutout, an annular flange with an internal thread is welded liquid-tight. The internal thread serves to receive the external thread of a screw-cap with which the canister is closed. However, the main purpose of the thread is to make it possible to screw in place a coupling piece so that the canister can be connected to a motor fuel supply system which pumps the required fuel out of the canister. In this manner, there is no need to pour the canister content into a tank. The annular flange has a perforation in the region close to the handles. This perforation is butted on the inside by a vent tube. To attach this tube, in addition, by welding would mean an excessive crowding together of welded joints so that there exists the danger that the directly adjacent internal thread is warped out of shape. Closing the container with the screw cap requires three and a half turns and thus takes a relatively long time. The screw cap may be seated very firmly. In order to make it possible to move it a few degrees of angle even with a hitting tool, four flaps have been rolled up along the outer circumference of the screw cap. The screwing on is impeded by the fact that a wire rod is provided which originates from the center of the screw cap, extends far beyond the screw cap and is fastened to the handles by a small chain or the like. The screw cap can, therefore, not be turned freely.

The screw cap has a rubber ring which has almost an I-cross section and sits with its internal circumference on the external thread provided at the external circumference of a cup which is sunk into the screw cap. This gasket ring also has the function of sealing the vent hole. The gasket ring is acted upon by very large pulling forces when the screw cap is tightened firmly or loosened. As a result, the gasket ring ages rapidly.

OBJECTS AND STATEMENT OF THE INVENTION

It is the objective of the invention to specify a closure of the type named initially which can, however, also be connected to such screw connections and thus combine the advantages of both systems. This problem is solved by the following characterizing features:

the internal ring in the threaded nipple is integral with the metallic collar and is composed of light metal, the internal ring has an axial internal thread with an inside diameter and outside diameter according to U.S. standard thread size for 20 liter canisters, (approximately 5.6 cm inside diameter, approximately 5.9 cm outside diameter), the radial faces of the collar and the internal ring are in radial alignment and set off from each other by an annular groove into which the inner annular flange on the lid bottom extends when the lid is closed, and the internal ring has a venting hole in the wall of the internal ring, and a venting tube is attached to the venting hole within the canister.

Advantageously, the invention has the following additional features:

The axis of the inner thread is displaced in the direction away from the venting hole and the cross section of the venting hole is enlarged by a corresponding amount. Through these characteristics, it is realized that substantially larger air volumes are able to flow successively into the interior of the canister.

The inner flange with its plunging volume displaces most of the volume of the annular groove when the lid is closed. Through these characteristics, one realizes not only a satisfactory guidance of the inner flange in the annular groove but also at that point practically no residual liquid can collect whose volume would be significant in comparison to the amount normally wetting a lid.

The outside diameter of the annular grove is smaller than 8.3 cm.

DESCRIPTION OF THE DRAWINGS

The invention will now be described with the aid of certain preferred examples of realization. On the drawing.

DETAILED DESCRIPTION OF A PREFERRED EMBODIMENT

Figure 1:
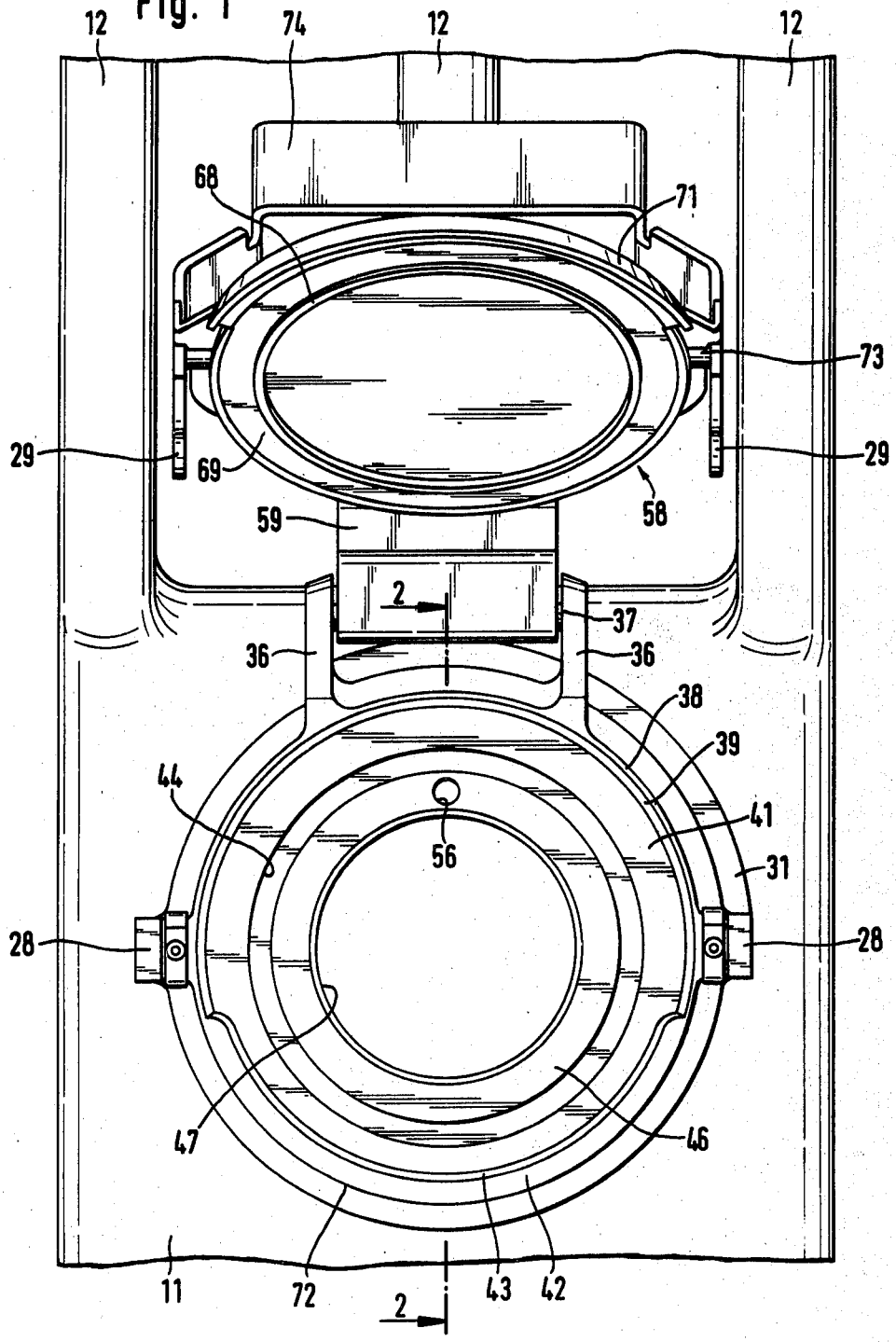
FIG. 1 shows a topview of the closing region of a plastic canister with the lid opened.

A plastic canister 11 produced by blowing, shown only in fragmentary form, holds 20 liters and has the usual three handles 12. It has a threaded nipple 13. For reasons related to the blowing process, this threaded nipple 13 has a smaller wall thickness than the wall 14 of the canister has in general. On the outside of the nipple 13, there is a coarse rectangular thread 16. The threaded nipple 13 has a frontal area 17. Since the threaded nipple 13 consists of blown material, it is reinforced by an insert ring 19 which is coaxial with the longitudinal geometric axis 18 and which is produced from the same material by injection molding and is, therefore, stiffer; it reinforces the threaded nipple 13 and has a bevel 21. In its outer terminal region, the insert ring 19 has a small coaxial flange 22 directed outwardly whose outer frontal area is radial, coaxial, annular, and has a precise geometry in this sense.

Figure 2:
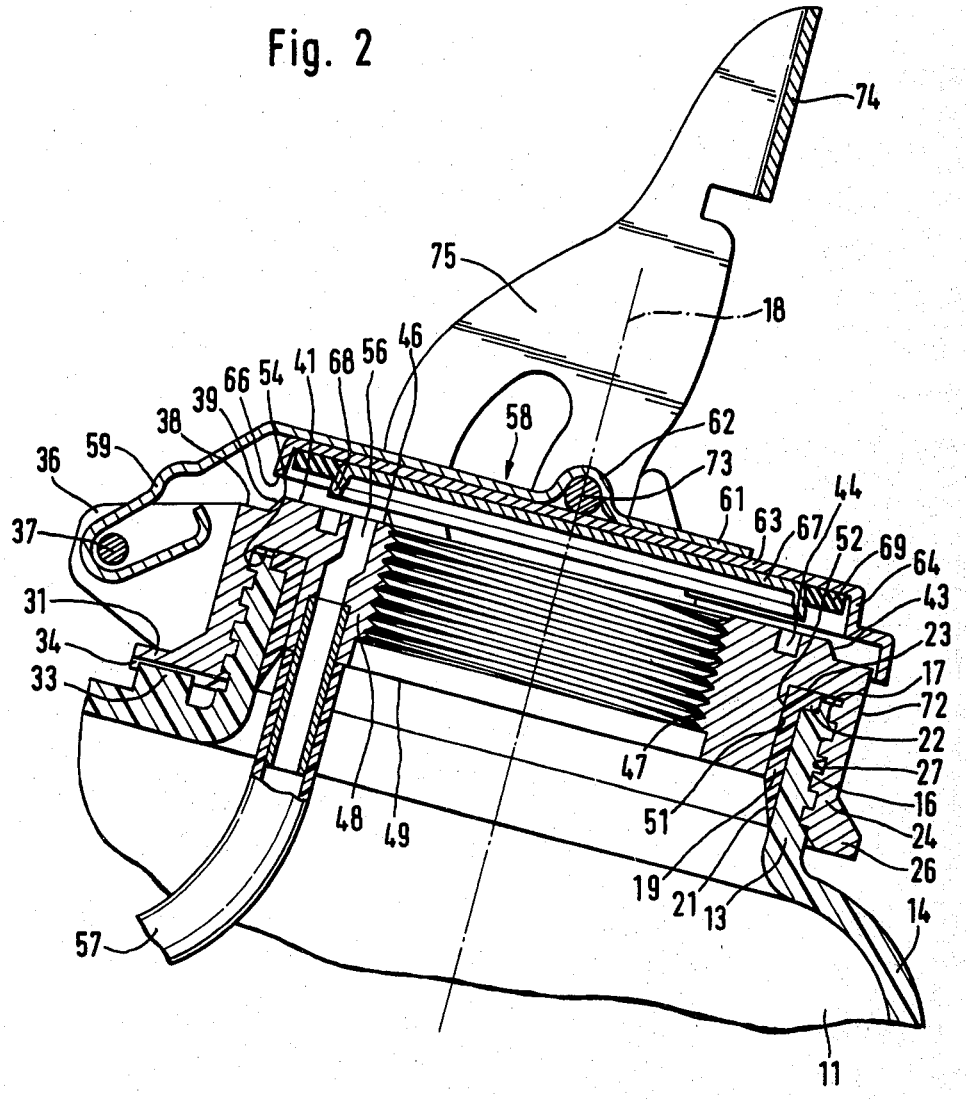
FIG. 2 shows a section along line 2—2 in FIG. 1.

As in evident from FIG. 2, the frontal area 23 projects very little beyond the frontal area 17 toward the outside. A design up to this point can, for example, be found in the U.S. Pat. No. 3,744,656. In the example of realization, the inside diameter of the insert ring is approximately 9 cm and, therefore, very large so that without the parts still to be described the canister can be called a wide-neck canister with an opening large enough for a man's fist to go through.

Figure 3:
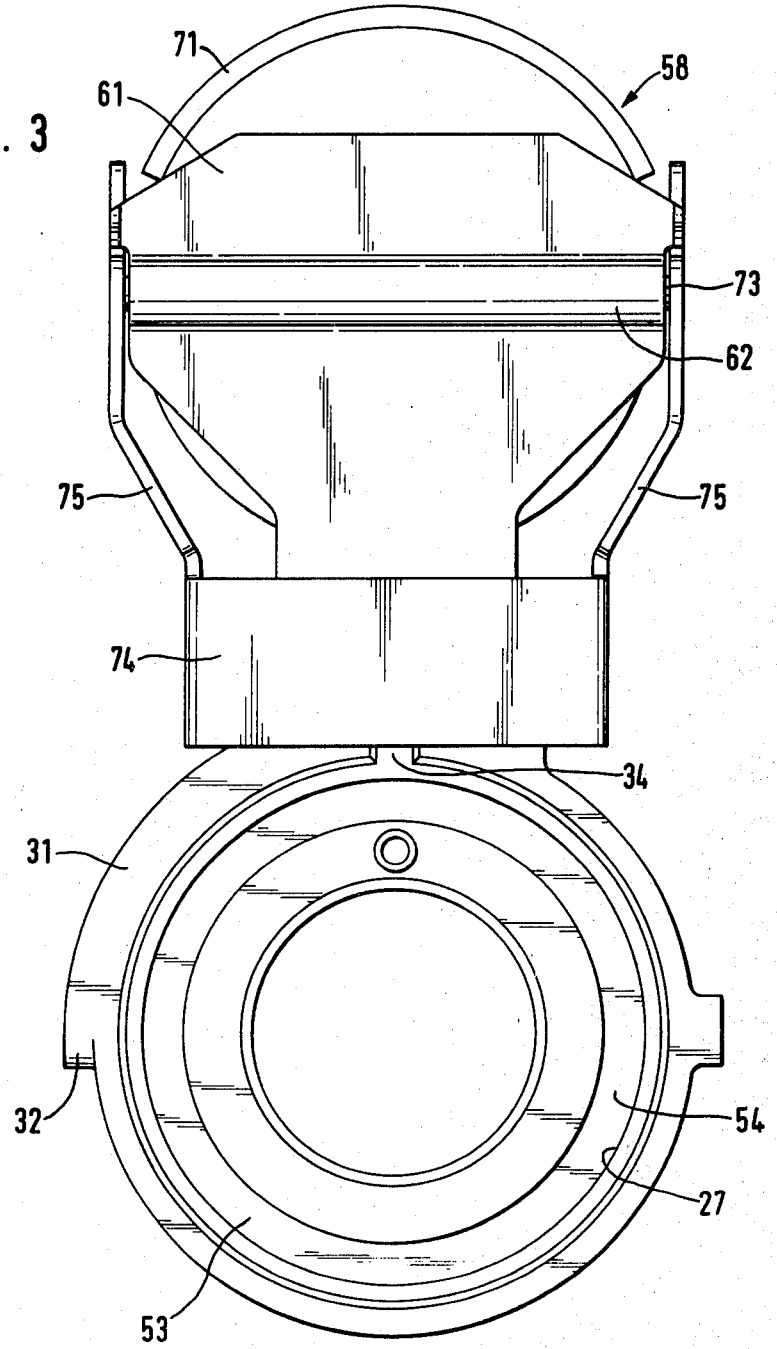
FIG. 3 shows a bottom-view of the closing element which has been unscrewed from the threaded plastic nipple.

Screwed onto the threaded nipple 13 is a collar 24 which is made of aluminum, has at its lower edge an apron 26 sloping toward the outside, is coaxial with the longitudinal axis 18, extends over the entire length of the threaded nipple 13 and has an internal thread 27 which is screwed onto the rectangular thread 16. On both sides, the collar 24 carries eyelets 28 which can be gripped by the claws 29. According to FIG. 3, from 9 to 12 o'clock, the apron 26 has an enlargement 31 with a run-up bevel 32 so that an upward-pointing projection 33 of the wall 14 is not sheared off during the last quarter-turn of the collar 24 but merely depressed and is then able to jump into a radial groove 34 so that the collar 24 is secured against any unintentional turning.

In its region facing toward the handles 12, the collar 24 has two parallel flaps 36 between which extends a hinge pin 37.

At the top and on the outside, the collar 24 has according to FIG. 1 from approximatey 8 to 4 o'clock a narow, radial shoulder 38 which ends in a short conical surface 39. On the outside, the conical surface 39 changes into a radial coaxial frontal area 41. At the level of the shoulder 38, there is provided, according to FIG. 1, from approximately 4 to approximately 8 o'clock a shoulder 42 extending farther toward the inside where it replaces about $\frac{1}{3}$ of the frontal area 41 and changes into a conical surface 43 in the direction of this frontal area. The frontal area 41 is followed toward the inside by a recessed groove 44 which runs all around. Within the groove 44 is provided once more a coaxial, annular, radial frontal area 46 which according to FIG. 2 extends axially exactly as far as the frontal area 41. On the inside, the frontal area 46 changes into an inwardly directed coaxial internal thread 47 which is cut into the inside wall of an internal ring 48 which extends toward the inside and forms an integral part of the collar 24. The internal ring 48 extends with its underside 49 approximately as far as the bevel 21 and with its coaxial cylindrical outside wall surface 51 it makes contact with the correspondingly shaped inside wall surface 52 of the insert ring 19. This contact is possible because the insert ring 19 is dimensionally true even though it is made of plastic while the dimensional trueness of the internal ring 48 presents no problem at all since it is made of an aluminum alloy. Between the outside wall surface 51 and the outside thread 27 there is an annular cavity 53 which has a radial coaxial bottom surface 54. According to FIG. 2, the threaded nipple 13 together with the insert ring 19 just fits into this cavity 53. In the cavity 53, a seal (not shown) must be provided which can be realized by bonding, wedging or else by a gasket ring which rests on the frontal area 23.

At 12 o'clock, a concentric through-hole 56 is provided in the internal ring 48 into which is inserted from below a vent tube 57 which extends into the posterior upper region of the canister.

A lid 58 is made of sheetmetal. It is integral with an articulated flap 59 which changes into a polygon 61. This polygon 61 has a high convexity 62 which in the closed states lies above the eyelets 28. The polygon 61 is welded onto a cover plate 63 which, seen from the top, is approximatey circular in shape. At its circumference, the cover plate 63 changes into a mounting edge 64 which is coaxial and nearly circular cylindrical with only a few degrees deviation from the circular cylindrical shape. The frontal area 66 lies in the closed state opposite the shoulder 38, but does not touch it. Also the conical surface 39 is not touched. However, the distance to both is small.

Coaxially from below, a dish-shaped centering disk 67 made of sheetmetal is welded to the cover plate 63. This disk is circular in shape and its edge 68 projects practically vertically from the cover plate 63 but has a height of only a few millimeters. In the closed state, the edge 68 fits in complementary fashion, into the groove 44. A rubber cord may be placed inside this groove for improved volume displacement.

In the space between the mounting edge 64 and the edge 68 is located a ring seal 69 with an I-cross section whose inner circumference is stretched with little tension over the edge 68. The ring seal 69 is 7 mm in width and it is, therefore, sufficient to hold it merely at its inner circumference. In the closed state, it rests under pressure against the frontal area 41.

According to FIG. 1, from approximately 10 o'clock to 2 o'clock the mounting edge 64 is joined by a sector 71 whose cross section approximates an L-profile. One leg of the L-profile lies parallel to the shoulder 42 and the other leg which extends cylindrically and coaxially reaches in the corresponding region over the outside 72 of the collar 42.

The claws 29 are parts of a double lever 75 whose transverse axle 73 is guided in the high convexity 62 and which at its rear end has an actuation plate 74.

Figure 4:
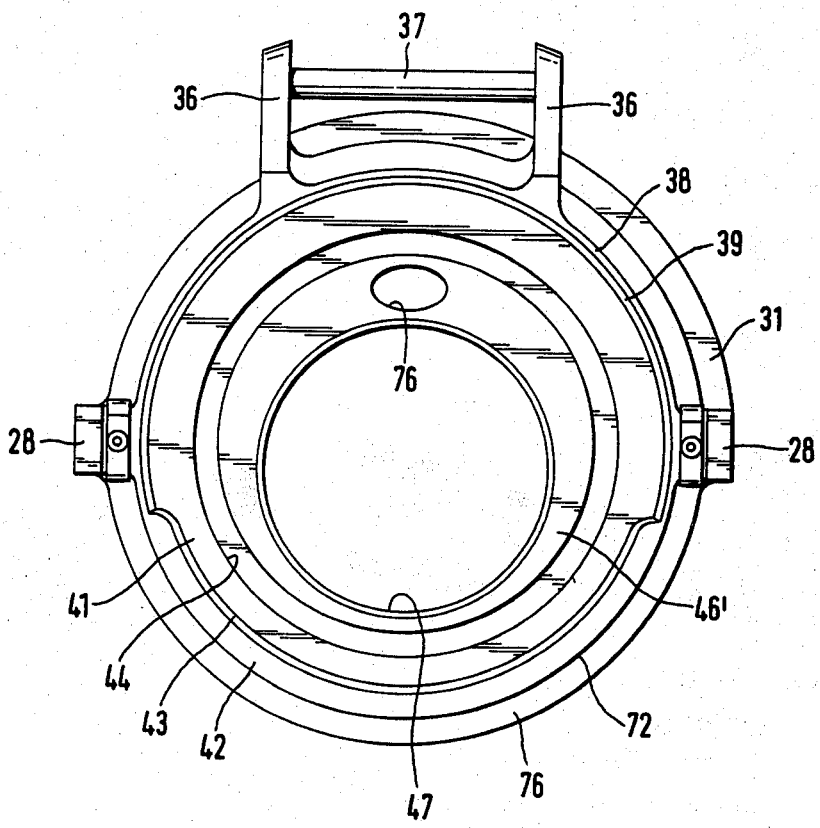
FIG. 4 shows a view of a second example of a realization similar to FIG. 1, but without the lid.

In the example of realization according to FIG. 4, the internal thread 47 is shifted far enough toward 6 o'clock so that the internal ring 48 has at that point still sufficient wall thickness. As a consequence, the wall thickness of the internal ring 48 at 12 o'clock becomes considerably greater and it is then possible to provide a through-hole 76 of oval shape which has a substantially larger cross section than the through-hole 56. This does not affect the geometry of the frontal area 41 as a sealing surface. The frontal area 46' which is now no longer annular in shape also remains large enough and the through-hole 76 also remains covered by the approximately 12 mm wide gaskets generally used in the screw caps. The outside diameter of such gaskets generally used in the screw caps amounts to 8.3 cm.

I claim:

1. In a closure for a container made of extruded plastic with a capacity in the 20–30 liter range with an integral plastic nipple having an external thread, comprising:

a metallic collar coaxial with the threaded nipple having two eyelets at its sides, a lid articulated to the collar, a double claw tiltably carried by the lid having claws which cooperate with the eyelets, an outer annular flange and an inner annular flange on the lid bottom, a ring seal held between the outer and inner flanges, an annular counter surface at the closure for the ring seal, and a coaxial internal ring in the threaded nipple having a radial flange which goes over the threaded nipple, the improvement in which:

the internal ring in the threaded nipple is integral with the metallic collar and is composed of light metal, the internal ring has an axial internal thread with an inside diameter and outside diameter according to U. S. standard thread size for 20 liter canisters, the radial faces of the collar and the internal ring are in radial alignment and set off from each other by an annular groove into which the inner annular flanges on the lid bottom extends when the lid is closed, and the internal ring has a venting hole in the wall of the internal ring, and a venting tube is attached to the venting hole within the canister.

2. Closure according to claim 1 in which the axis of the internal thread of the internal ring is displaced in the direction away from the venting hole and the cross section of the venting hole is enlarged by a corresponding amount.

3. Closure according to claim 1 in which the inner annular flange on the lid bottom displaces most of the volume of annular groove when the lid is closed.

4. Closure according to claim 1 in which the annular groove has an outside diameter less than 8.3 cm.

* * * * *